US010280813B2

(12) United States Patent
Maehara

(10) Patent No.: US 10,280,813 B2
(45) Date of Patent: May 7, 2019

(54) ROLLER-TYPE ROCKER ARM

(71) Applicant: Kabushiki Kaisha Riken, Tokyo (JP)

(72) Inventor: Mitsuhiro Maehara, Saitama (JP)

(73) Assignee: Kabushiki Kaisha Riken, Tokyo (JP)

( * ) Notice: Subject to any disclaimer, the term of this patent is extended or adjusted under 35 U.S.C. 154(b) by 117 days.

(21) Appl. No.: 15/508,290

(22) PCT Filed: Apr. 14, 2015

(86) PCT No.: PCT/JP2015/061489
§ 371 (c)(1),
(2) Date: Mar. 2, 2017

(87) PCT Pub. No.: WO2016/035373
PCT Pub. Date: Mar. 10, 2016

(65) Prior Publication Data

US 2017/0284233 A1 Oct. 5, 2017

(30) Foreign Application Priority Data

Sep. 2, 2014 (JP) ..... 2014-178412

(51) Int. Cl.
*F01L 1/18* (2006.01)

(52) U.S. Cl.
CPC ..... *F01L 1/181* (2013.01); *F01L 1/18* (2013.01); *F01L 1/185* (2013.01); *F01L 2101/00* (2013.01); *F01L 2105/00* (2013.01)

(58) Field of Classification Search
None
See application file for complete search history.

(56) References Cited

U.S. PATENT DOCUMENTS 5,979,384 A * 11/1999 Oka ..... F01L 1/14 123/90.42
2002/0097939 A1* 7/2002 Matsuyama ..... F16C 33/3856 384/572
2004/0241448 A1* 12/2004 Kano ..... C10M 141/10 428/408
2010/0024592 A1 2/2010 Maurin-Perrier et al.
2011/0021390 A1 1/2011 Mori et al.
(Continued)

FOREIGN PATENT DOCUMENTS

CN 102251820 A 11/2011
DE 102012207518 A1 11/2013
(Continued)

OTHER PUBLICATIONS

Extended European Search Report and European Search Opinion dated Mar. 27, 2018.
(Continued)

*Primary Examiner* — Mark A Laurenzi
*Assistant Examiner* — Wesley G Harris
(74) *Attorney, Agent, or Firm* — Slater Matsil, LLP

(57) ABSTRACT

A roller-type rocker arm had a function for transmitting a rotational motion of a cam to an intake and exhaust valve. The roller-type rocker arm includes a roller shaft, an inner ring roller slidably attached to an outer circumference surface of the roller shaft, and an outer ring roller slidably attached to an outer circumference surface of the inner ring roller. The inner ring roller is made of a resin material.

20 Claims, 7 Drawing Sheets

(56) References Cited

U.S. PATENT DOCUMENTS

| | | | | |
|---|---|---|---|---|
| 2012/0183246 | A1* | 7/2012 | Oki | F16C 23/046<br>384/286 |
| 2013/0195388 | A1 | 8/2013 | Ishii et al. | |

FOREIGN PATENT DOCUMENTS

| | | | |
|---|---|---|---|
| JP | 2004278322 | A | 10/2004 |
| JP | 2006194139 | A | 7/2006 |
| JP | 200930467 | A | 2/2009 |
| JP | 2010065843 | A | 3/2010 |
| JP | 201126591 | A | 2/2011 |
| JP | 2012241774 | A | 12/2012 |

OTHER PUBLICATIONS

Response to the Extended European Search Report and European Search Opinion dated Aug. 16, 2018.

* cited by examiner (A) Sliding type (B) Rolling type

ROLLER-TYPE ROCKER ARM

CROSS-REFERENCE TO RELATED APPLICATIONS

This patent application is a national phase filing under section 371 of PCT/JP2015/061489, filed Apr. 14, 2015, which claims the priority of Japanese patent application 2014-178412, filed Sep. 2, 2014, each of which is incorporated herein by reference in its entirety.

TECHNICAL FIELD

The present invention relates to a rocker arm-type valve mechanism in an internal combustion engine, in particular, to a sliding roller-type rocker arm configuration with improved friction performance.

BACKGROUND

For transmission of lift operation of a camshaft for opening/closing an intake and exhaust valve in a valve mechanism of four-stroke internal combustion engine, a tappet is used in a direct-hit type, and a rocker arm is used in a rocker arm type. The tappet or the rocker arm is provided between the camshaft and the intake and exhaust valve. When the valve is open, the tappet or the rocker arm is lifted while overcoming the reaction force of a valve spring. When the valve is closed, the tappet or the rocker arm is moved while pushed back by the valve spring, and the load from such spring force as well as the inertial force of the valve mechanism is constantly generated.

Recently, a rocker arm provided with a roller is widely employed for improved fuel efficiency. Such roller-type rocker arm includes four components in total, including a main body referred to as a body, an outer ring roller sliding with a camshaft, a shaft supporting the outer ring roller, and a small-diameter solid shaft referred to as a rolling element or a hollow roller referred to as an inner ring, which is between the shaft and the outer ring roller. The former using the rolling element is referred to as a rolling-type, and the latter using the inner ring roller is referred to as a sliding type.

FIG. 1(A) shows a schematic perspective view of a sliding-type rocker arm, and FIG. 1(B) shows a schematic perspective view of a rolling-type rocker arm, with the body of the rocker arm omitted. A sliding-type rocker arm 10 includes a roller shaft 12, an inner ring roller 14 rotatably attached to the roller shaft 12, and an outer ring roller 16 rotatably attached to the outer surface of the inner ring roller 14. A rolling-type rocker arm 20 includes a roller shaft 22, a plurality of needle rollers 24 rotatably attached to the outer surface of the roller shaft 22, and a roller 26 a rotatably attached to the outer surface of the needle roller 24.

FIG. 2 shows an example diagram of a rolling-type rocker arm provided between a cam of a camshaft and a valve stem of an intake and exhaust valve. The rocker arm includes a body 30 holding rotatably a roller 26 as shown in FIG. 1(B). A first end 32 of the body 30 is supported by a pivot portion 34, a second end 36 is abutted to a cap 38 of a valve stem 37 of the intake and exhaust valve, and a valve spring 39 energizing the second end 36 of the rocker arm is attached under the cap 38. The roller 26 is abutted to a cam 40, and the rotary motion of the cam 40 is transmitted to the body 30. Thus, according to the rotation of the cam 40, the second end 36 moves the intake and exhaust valve vertically. The sliding-type rocker arm is used in the same manner. FIG. 2A shows another example in which a rocker arm is supported by a hydraulic lash adjuster. As shown in FIG. 2A, a first end 32 of the rocker arm is contacted with a plunger 52 with a semispherical top and the plunger 52 is supported by the lash adjuster 60. The lash adjuster 60 supports the plunger 52 such that it can slide in an axial direction. Such lash adjuster-type rocker arms are disclosed in Japanese patent documents JP2011-1906A and JP2012-154226A, which allow lubrication oil to be smoothly supplied to an opening for lubrication oil in the roller shaft through the lash adjuster.

The rolling type has better friction performance compared to the sliding type because the rolling elements are rolling during operation. However, the rolling elements being slided are almost in line-contact with the shaft or the outer ring. Particularly, the rolling elements and the shaft have high contact pressure according to the Hertz's contact theory because the rolling elements have a small outer diameter which causes the contacts of both convex R to convex R.

In the sliding type, a lift load of a camshaft is supported by an inner circumference surface of an outer ring roller, an outer circumference surface of an inner ring roller, an inner circumference surface of the inner ring roller, and an outer circumference surface of a roller shaft. The inner ring roller and the roller shaft, which have the highest contact pressures, are used with lower contact pressure compared to rolling type because the inner ring roller has the wider inner diameter than the rolling element and thus the concave R to convex R contact is occurred for the roller shaft. Each sliding surface has a clearance and makes a relative motion while sliding. Thus, the friction performance is de-graduated especially in the low revolution range due to the boundary lubrication state.

To improve fuel efficiency, there is a need to reduce the friction of the sliding portions. Also, to ensure the ability to smoothly transmit a lift operation for a long period, wear-resistance and scaffing-resistance are needed for the sliding portions. For such a conventional rocker arm, the techniques for suppressing wearing (see Japanese patent document JP2008-255883A) and for supplying lubricating oil efficiently (see Japanese patent documents JP2007-023817A and JP2007-0263023A) have been disclosed. Further, the technique for avoiding damages or scaffings by providing lubricant film to a circumference surface of an inner ring roller (see Japanese patent document JP2000-034907A) has been disclosed.

SUMMARY

In a rocker arm of the sliding type, an inner surface of an outer ring roller, an outer surface of an inner ring roller, an inner surface of the inner ring roller, and an outer surface of a roller shaft respectively act as a sliding surface, and have a clearance. Conventionally, fabrication of such sliding surface is finished by adjusting surface roughness using barrel after polishing for shape creation.

During movement, splash lubrication using lubricating oil in a sprayed-form present in an atmosphere of a cylinder head is provided for lubricating to the sliding surfaces. Thus, a small amount of lubricating oil is originally provided. Thus, there is concern for the friction of the sliding surface. In particular, the conventional sliding-type rocker arm has a problem that the friction is greater compared to the rolling-type rocker arm due to the boundary lubrication state in the low revolution range (mainly low revolution not greater than 1000 rpm at idling of engine).

To solve the above problems, the present invention intends to provide a roller-type rocker arm which may reduce the friction in low and high revolution ranges of an engine.

According to the present invention, a roller-type rocker arm provided with a function for transmitting a rotational motion of a cam to an intake and exhaust valve comprises a roller shaft, an inner ring roller made of a resin material, the inner ring roller slidably attached to an outer circumference surface of the roller shaft, and an outer ring roller slidably attached to an outer circumference surface of the inner ring roller.

Preferably, the resin material includes polyetheretherketon (PEEK), polyphenylenesulfide (PPS), polytetrafluoroethene (PTFE), polyethersulphone (PES), polybensimidazole (PBI), polyimide (PI), or poliamide (PAT). Preferably, the resin material includes any carbon fiber, CNT (carbon nano tube), CNC (carbon nano coil), or reinforced fiber with glass fiber. Preferably, the reinforce fiber is arranged approximately in parallel to the sliding direction of the inner ring roller. Preferably, at least one of the counterpart members that slide on the outer circumference surface and the inner circumference surface of the inner ring roller is formed with an amorphous hard carbon coat.

According to the present invention, the inner ring roller made of resin material may reduce the friction caused by sliding in low and high revolution ranges of the engine compared to the conventional roller-type rocker arm.

BRIEF DESCRIPTION OF THE DRAWINGS

FIG. 5(A) shows a perspective view of a roller shaft, FIG. 5(B) shows a perspective view of an inner ring roller, and FIG. 5(C) shows a perspective view of an outer ring roller.

Figure 1:
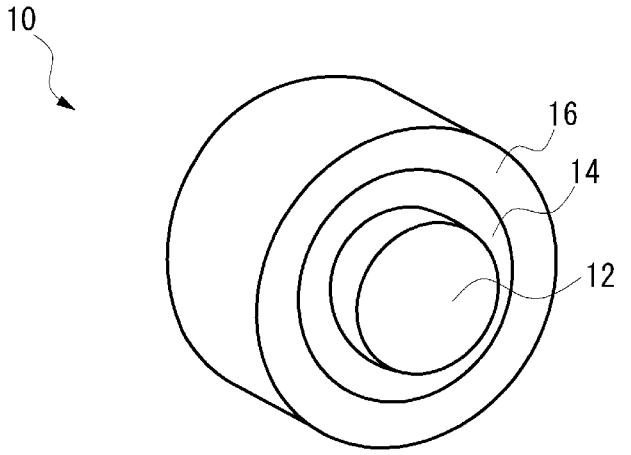
FIG. 1(A) shows a schematic perspective view of a conventional roller-type rocker arm (in a sliding type)
FIG. 1(B) shows a schematic perspective view of a conventional roller-type rocker arm (in a rolling type).
Figure 1:
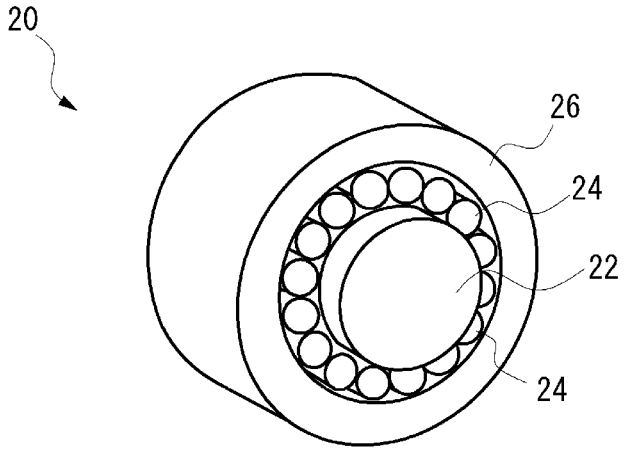

The following reference numerals are used with the drawings:

100: rocker arm
110: body
120: roller shaft
122: outer circumference surface
130: inner ring roller
132: inner circumference surface
134: outer circumference surface
140: outer ring roller
142: inner circumference surface
144: outer circumference surface

DETAILED DESCRIPTION OF ILLUSTRATIVE EMBODIMENTS

Now, embodiments for implementing the present invention will be described in detail. It should be noted that the drawings are not necessarily to scale, with emphasis instead being placed upon illustrating components for clarity.

Figure 3:
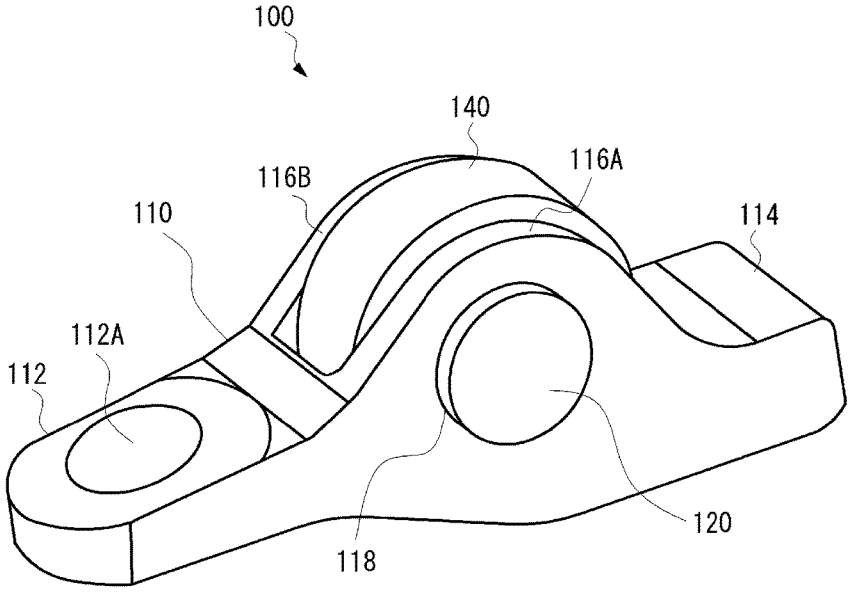
FIG. 3 shows a schematic external perspective view of a roller-type rocker arm according to an embodiment of the present invention.
Figure 4:
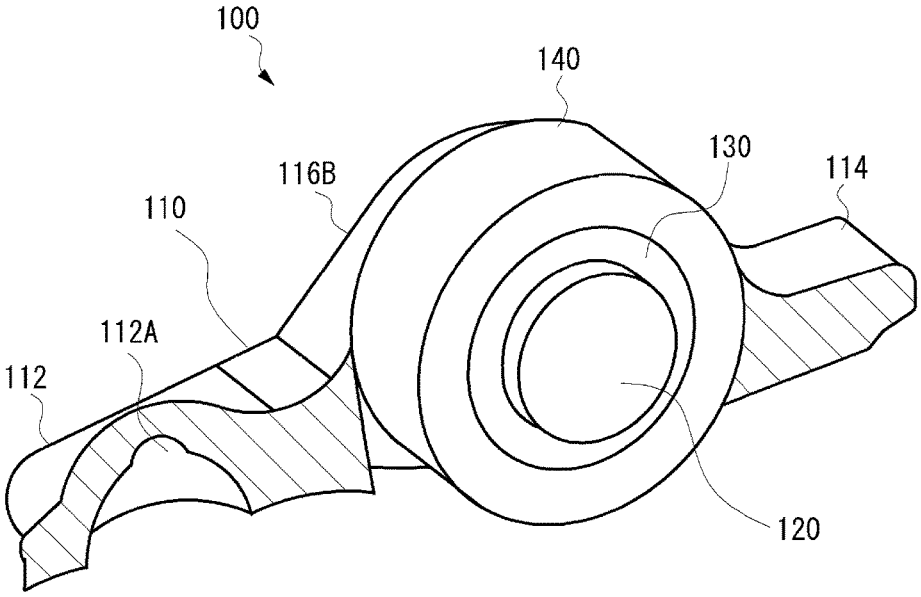
FIG. 4 shows a schematic diagram of a body of the rocker arm shown in FIG. 3, with a portion of the body eliminated.
Figure 5:
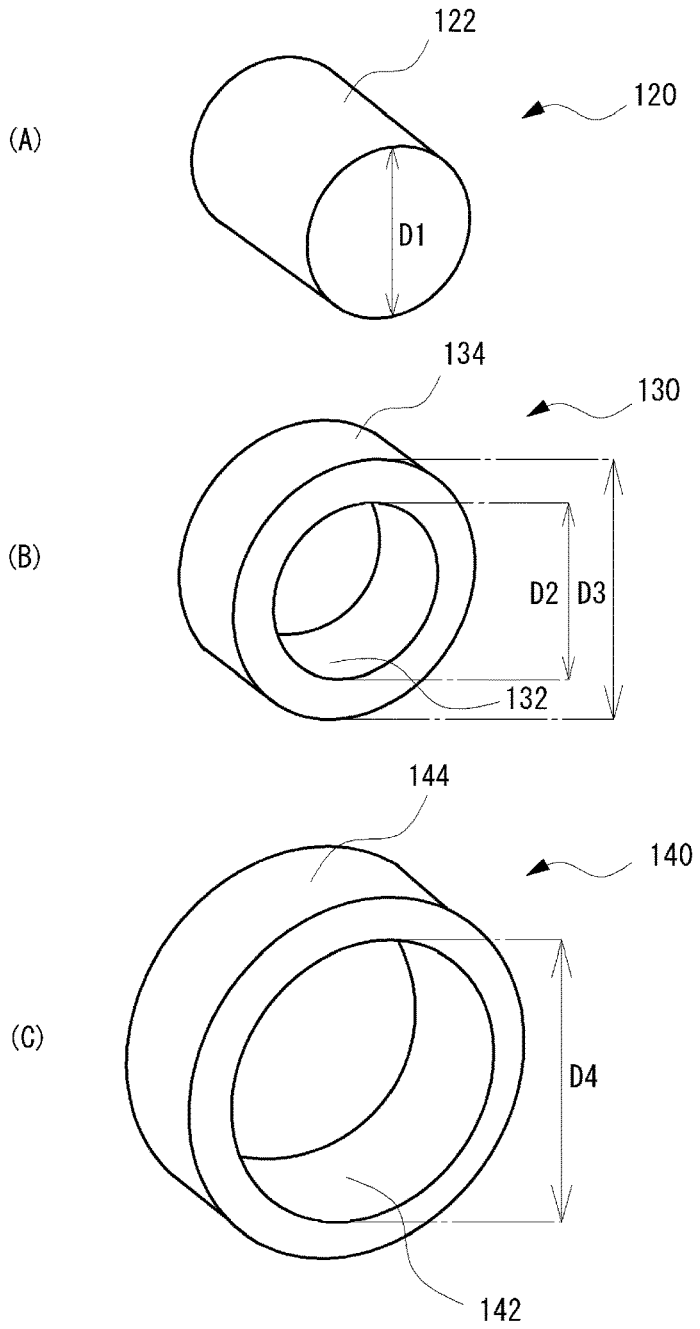
FIG. 5 shows diagrams indicating each component of a rocker arm according to an embodiment of the present invention.
Figure 6:
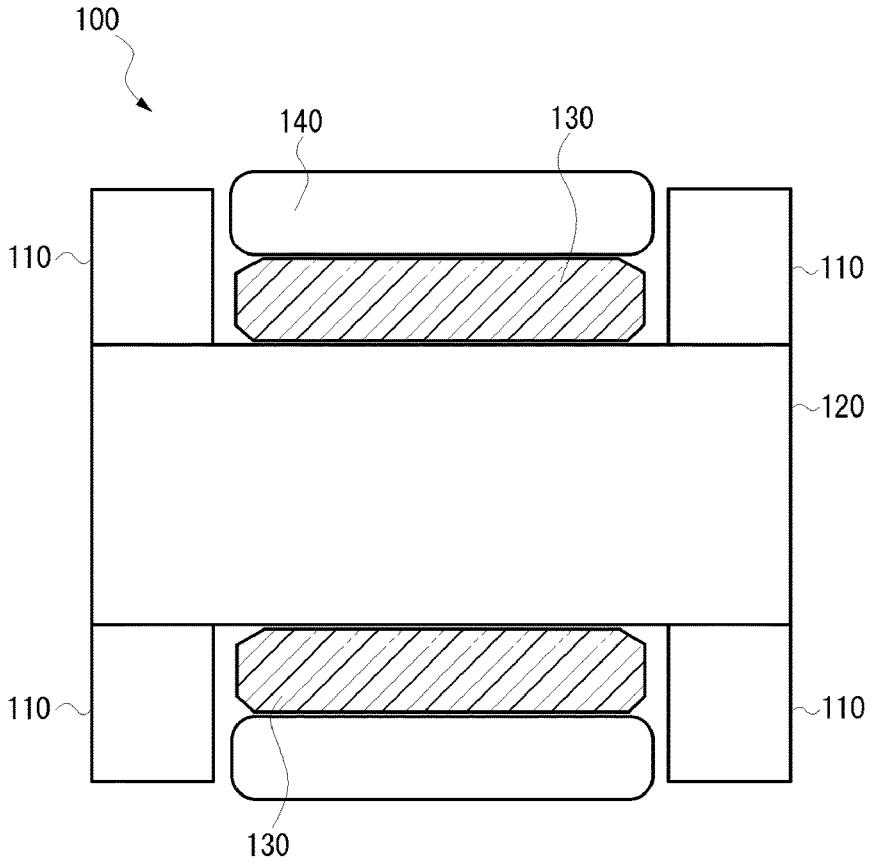
FIG. 6 shows a cross sectional view of a roller-type rocker arm according to an embodiment of the present invention.

FIG. 3 shows a perspective view of a whole rocker arm according to an embodiment of the present invention, FIG. 4 shows a partially cutaway view with the body of the rocker arm shown in FIG. 3 partially omitted, FIG. 5 shows a perspective view of each component, and FIG. 6 shows a general cross sectional view of a rocker arm. A rocker arm according to an embodiment of the present invention is one component for a rocker arm-type valve mechanism of a 4-stroke internal combustion engine and relates to a sliding rocker arm.

As shown in FIG. 3 and FIG. 4, a rocker arm 100 according to an embodiment includes a body 110, a roller shaft 120 fixed within the body 110, an inner ring roller 130 rotatably attached to the outer circumference of the roller shaft 120, and the outer ring roller 140 rotatably attached to the outer circumference of the inner ring roller 130.

Figure 2:
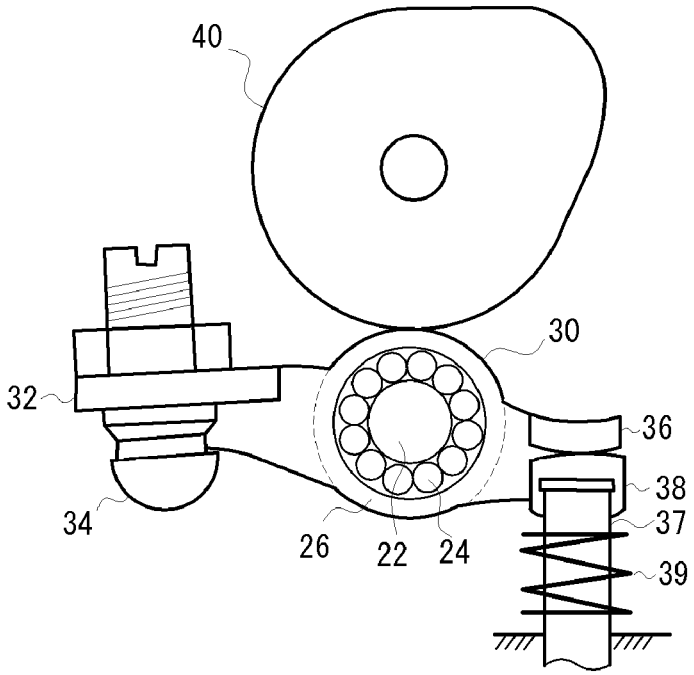
FIG. 2 shows an example diagram of a rocker arm operated by a cam.
Figure 2A:
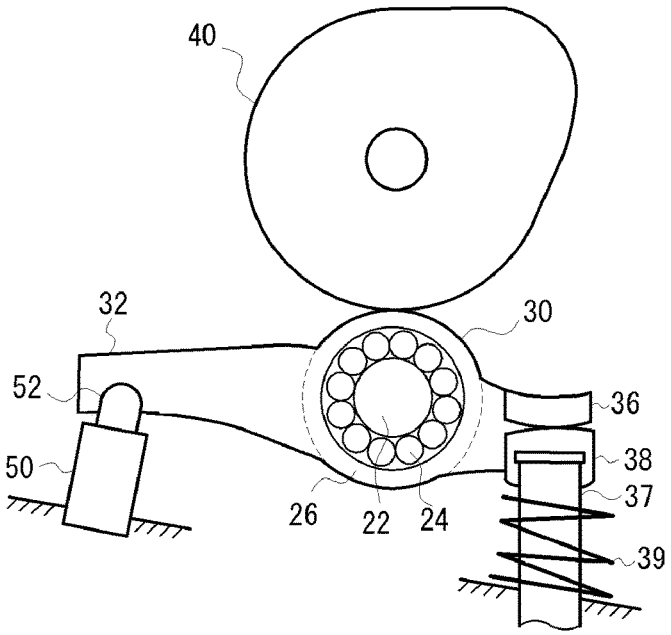
FIG. 2A shows another example diagram with a rocker arm applied to a combustion engine.

The body 110 is a metal member for supporting the roller shaft 120, the inner ring roller 130 and the outer ring roller 140. An opening 112A is provided to support a pivot portion 34 (show in FIG. 2) at a first end 112, and a cap 38 of a valve stem of an intake and exhaust valve is abutted to a second end 114. A pair of spaced side walls 116A, 116B are provided between the first end 112 and the second end 114 of the body 110. A circular-shaped through holes 118 is provided on the pair of side walls 116A, 116B respectively. The roller shaft 120 is installed in the through holes 118 of the pair of side walls 116A, 116B.

The roller shaft 120 is a metal member having a uniform diameter D1 as shown in FIG. 5(A), and inserted into each through hole 118 of the pair of side walls 116A, 116B as the above-described. Preferably, the diameter D1 of the roller shaft 120 is equal to or slightly greater than the diameter of the through holes 118. The roller shaft 120 is fastened within the through holes 118 by crimping, etc.

The inner ring roller 130 is an annular member installed to cover the outer circumference of the roller shaft 120 between the side walls 116A, 116B. The inner ring roller 130 is made of resin material. As shown in FIG. 5(B), the inner ring roller 130 has an inner circumference surface 132 with an inner diameter D2 and an outer circumference surface 134 with an outer diameter D3. The inner diameter D2 is provided with a certain clearance such that the inner diameter D2 is slightly greater than the diameter of the roller shaft 120, i.e., D2>D1. Thus, the inner circumference surface 132 of the inner ring roller 130 may be slid on the outer circumference surface 122 of the roller shaft 120.

The outer ring roller 140 is an annular metal member installed to cover the outer circumference of the inner ring roller 130 between the side walls 116A, 116B. As shown in FIG. 5(C), the outer ring roller 140 has an inner circumference surface 142 with an inner diameter D4 and an outer circumference surface 144. The inner diameter D4 of the outer ring roller 140 is provided with a certain clearance such that the inner diameter D4 is slightly greater than the outer diameter D3 of the inner ring roller 130, i.e., D4>D3. Thus, the inner circumference surface 142 of the outer ring roller 140 may be slid around the outer circumference surface 134 of the inner ring roller 130.

The feature of the rocker arm according to the present embodiment is that, as mentioned above, the inner ring roller 130 is made of resin material. Preferably, the resin material has excellent sliding characteristics for the metal material, wear resistance, and affinity for lubricating oil, such as PEEK (polyetheretherketon), PPS (polyphenylenesulfide), PTFE (polytetrafluoroethene), PES (polyethersulphone), PBI (polybensimidazole), PI (polyimide) or PAI (poliamide). The inner ring roller may be formed by molding such resin materials.

More preferably, to enhance the mechanical strength and wear resistance etc. of resin materials, a reinforced member may be mixed therewith. The reinforced member is for example a reinforced fiber such as a carbon fiber, a CNT (carbon nano tube), a CNC (carbon nano coil), and a reinforced fiber such as a glass fiber. Also a lubricating material such as a graphite and a molybdenum disulfide, and a wear resistance fine particle of a metal and a ceramic may be mixed together with the reinforced fiber. Furthermore in case such reinforced fibers are incorporated into the resin material, the reinforced fibers are arranged approximately in parallel to the sliding direction (periphery direction) of the inner ring roller 130, thereby reducing the friction additionally.

Table 1 shows a comparison of the friction torques as a result of an evaluation experiment of a rocker arm according to the present embodiment and a rocker arm with another configuration. A comparative example 1 is for the rolling-type rocker arm (see FIG. 1(B)), and a comparative example 2 is for the conventional sliding-type rocker arm made of metal material. Numeric value represents comparative data assuming that the friction torque of each cam revolution of comparative example 1 is "1".

It is evident from the evaluation experiment that the friction torque of the conventional sliding-type rocker arm (comparative example 2) is lower in the high revolution range and greater in the low revolution range compared to the rolling-type rocker arm (comparative example 1). On the other hand, it can be seen that the friction of the rocker arm according to the present embodiment is lower than the friction of rolling-type rocker arm (comparative example 1) in the low revolution range as well as the friction of the conventional sliding-type rocker arm in the high revolution range. As mentioned, according to the embodiment, the inner ring roller 130 made of resin material may reduce the friction in the low and high revolution ranges compared to the conventional sliding-type rocker arm.

TABLE 1

| /cam revolution (rpm) | 500 | 1000 | 2000 | 3000 |
|---|---|---|---|---|
| Example | 0.75 | 0.71 | 0.71 | 0.77 |
| comparative example 1 | 1 | 1 | 1 | 1 |
| comparative example 2 | 1.6 | 1.07 | 0.71 | 0.77 |

Now, a second embodiment of the present invention will be described. In the second embodiment, the sliding surfaces of the counterpart members that slide on the inner ring roller 130 made of resin, namely, at least one of the inner circumference surface of the outer ring roller 140 and the outer circumference surface of the roller shaft 120 is formed with an amorphous hard carbon coat (referred to as DLP (Diamond like carbon) coat hereinafter). Such DLC coat may be formed by PVD, CVD and PACVD techniques. A coat formed by PVD, especially by arc ion plating, in which the amount of hydrogen contained is not greater than 0.5 atomic percent, is preferable in view of hardness and wear resistance. DLC coat thickness is for example 0.3-1.5 micro meter in case of PVD, and preferably is not greater than 1.0 micro meter. In case of CVD, DLC coat may have approximately 20 micro meter thickness.

By forming DLC coat on the sliding surfaces of the roller shaft 120 and the outer ring roller 140 that slides on the inner ring roller 130 made of resin, the friction between the inner ring roller 130 and the roller shaft 120 and/or between the inner ring roller 130 and the outer ring roller 140 may be reduced.

Although it is shown in the above embodiment that DLC coat is formed on the sliding surfaces of the counterpart members sliding on the inner ring roller 130, besides the above configuration, DLC coat may be formed on the outer circumference surface and inner circumference surface of the inner ring roller 130 if the advantage of reducing friction can be obtained, thus DLC coat may be formed on the inner circumference surface of the outer ring roller 140, the outer circumference surface of the inner ring roller 130, the outer circumference surface of the roller shaft 120 and the inner circumference surface of the inner ring roller 130, respectively.

While the preferred embodiments according to the present invention were described above, the present invention is not limited to such specific embodiments. The present invention may be modified or changed without departing from the scope of the present invention according to the appended claims.

What is claimed is:

1. A roller-type rocker arm having a function for transmitting a rotational motion of a cam to an intake and exhaust valve, the roller-type rocker arm comprising:

a roller shaft with a diameter D1, the roller shaft made of metal;

an inner ring roller made of a resin material, the inner ring roller having an inner diameter D2 that is greater than the diameter D1 and an outer diameter D3, wherein the inner ring roller slidably is attached to an outer circumference surface of the roller shaft; and an outer ring roller with an inner diameter D4 greater than the outer diameter D3 and an outer diameter D5, the outer ring roller made of metal and slidably attached to an outer circumference surface of the inner ring roller, wherein the outer ring roller is designed to contact with the cam;

wherein a clearance is formed between an inner circumference surface of the inner ring roller and the outer circumference surface of the roller shaft, and a clearance is formed between the outer circumference surface of the inner ring roller and an inner circumference surface of the outer ring roller; and wherein the resin material comprises a material selected from the group consisting of polyetheretherketon, polyphenylenesulfide, polytetrafluoroethene, polyethersulphone, polybensimidazole, polyimide and poliamide.

2. The roller-type rocker arm according to claim 1, wherein the resin material further includes a material selected from the group consisting of a carbon fiber, CNT (carbon nano tube), CNC (carbon nano coil), and reinforced fiber with a glass fiber.

3. The roller-type rocker arm according to claim 1, wherein the resin material includes reinforced fibers that are arranged approximately in parallel to a sliding direction of the inner ring roller.

4. The roller-type rocker arm according to claim 3, wherein the reinforced fibers are formed from a material selected from the group consisting of a carbon fiber, CNT (carbon nano tube), CNC (carbon nano coil), and reinforced fiber with a glass fiber.

5. The roller-type rocker arm according to claim 1, wherein the outer circumference surface of the inner ring roller is slidably attached to an outer circumference surface of the roller shaft is formed with an amorphous hard carbon coat.

6. The roller-type rocker arm according to claim 1, wherein an inner surface of the outer ring roller is formed with an amorphous hard carbon coat.

7. A roller-type rocker arm having a function for transmitting a rotational motion of a cam to an intake and exhaust valve, the roller-type rocker arm comprising:

a roller shaft having a diameter D1 and an outer circumference surface formed with an amorphous hard carbon coat, the roller shaft being made of metal;

an inner ring roller made of a resin material and having an inner diameter D2 greater than the diameter D1 and an outer diameter D3, the inner ring roller slidably attached to the outer circumference surface of the roller shaft, wherein the resin material comprises a material selected from the group consisting of polyetheretherketon, polyphenylenesulfide, polytetrafluoroethene, polyethersulphone, polybensimidazole, polyimide and poliamide; and an outer ring roller having an inner diameter D4 greater than the outer diameter D3, an outer diameter D5, and an inner circumference surface that is slidably attached to an outer circumference surface of the inner ring roller, the outer ring being made of metal and the inner surface of the outer ring roller being formed with an amorphous hard carbon coat;

wherein a clearance is formed between an inner circumference surface of the inner ring roller and the outer circumference surface of the roller shaft, and a clearance is formed between the outer circumference surface of the inner ring roller and an inner circumference surface of the outer ring roller.

8. The roller-type rocker arm according to claim 7, wherein the resin material further includes a material selected from the group consisting of a carbon fiber, CNT (carbon nano tube), CNC (carbon nano coil), or reinforced fiber with a glass fiber.

9. The roller-type rocker arm according to claim 7, wherein the resin material includes reinforced fibers that are arranged approximately in parallel to a sliding direction of the inner ring roller.

10. A roller-type rocker arm having a function for transmitting a rotational motion of a cam to an intake and exhaust valve, the roller-type rocker arm comprising:

a roller shaft having an outer circumference surface formed with an amorphous hard carbon coat;

an inner ring roller made of a resin material, the inner ring roller slidably attached to the outer circumference surface of the roller shaft, wherein the resin material includes reinforced fibers that are arranged approximately in parallel to a sliding direction of the inner ring roller; and an outer ring roller having an inner circumference surface that is slidably attached to an outer circumference surface of the inner ring roller, the inner surface of the outer ring roller being formed with an amorphous hard carbon coat.

11. The roller-type rocker arm according to claim 10, wherein the resin material comprises a material selected from the group consisting of polyetheretherketon, polyphenylenesulfide, polytetrafluoroethene, polyethersulphone, polybensimidazole, polyimide and poliamide.

12. The roller-type rocker arm according to claim 10, wherein the reinforced fibers comprise a carbon fiber.

13. The roller-type rocker arm according to claim 10, wherein the reinforced fibers comprise a carbon nano tube.

14. The roller-type rocker arm according to claim 10, wherein the reinforced fibers comprise a carbon nano coil.

15. The roller-type rocker arm according to claim 10, wherein the reinforced fibers comprise a reinforced fiber with a glass fiber.

16. A roller-type rocker arm having a function for transmitting a rotational motion of a cam to an intake and exhaust valve, the roller-type rocker arm comprising:

a roller shaft;

an inner ring roller made of a resin material, the inner ring roller slidably attached to an outer circumference surface of the roller shaft; and an outer ring roller slidably attached to an outer circumference surface of the inner ring roller;

wherein the resin material comprises a material selected from the group consisting of polyetheretherketon, polyphenylenesulfide, polytetrafluoroethene, polyethersulphone, polybensimidazole, polyimide and poliamide; and wherein the resin material includes reinforced fibers that are arranged approximately in parallel to a sliding direction of the inner ring roller.

17. The roller-type rocker arm according to claim 16, wherein the reinforced fibers are formed from a material selected from the group consisting of a carbon fiber, CNT (carbon nano tube), CNC (carbon nano coil), and reinforced fiber with a glass fiber.

18. The roller-type rocker arm according to claim 16, wherein:

the roller shaft is made of metal;

the roller shaft has a diameter D1;

the inner ring roller has an inner diameter D2 that is greater than the diameter D1 and an outer diameter D3;

the outer ring roller has an inner diameter D4 greater than the outer diameter D3 and an outer diameter D5;

the outer ring roller is designed to contact with the cam;

a clearance is formed between an inner circumference surface of the inner ring roller and the outer circumference surface of the roller shaft; and a clearance is formed between the outer circumference surface of the inner ring roller and an inner circumference surface of the outer ring roller.

19. A roller-type rocker arm having a function for transmitting a rotational motion of a cam to an intake and exhaust valve, the roller-type rocker arm comprising:

a roller shaft having an outer circumference surface formed with an amorphous hard carbon coat;

an inner ring roller made of a resin material, the inner ring roller slidably attached to the outer circumference surface of the roller shaft, wherein the resin material comprises a material selected from the group consisting of polyetheretherketon, polyphenylenesulfide, polytetrafluoroethene, polyethersulphone, polybensimidazole, polyimide and poliamide and wherein the resin material includes reinforced fibers that are arranged approximately in parallel to a sliding direction of the inner ring roller; and an outer ring roller having an inner circumference surface that is slidably attached to an outer circumference surface of the inner ring roller, the inner surface of the outer ring roller being formed with an amorphous hard carbon coat.

20. The roller-type rocker arm according to claim 19, wherein:

the roller shaft is made of metal;

the roller shaft has a diameter D1;

the inner ring roller has an inner diameter D2 that is greater than the diameter D1 and an outer diameter D3;

the outer ring roller has an inner diameter D4 greater than the outer diameter D3 and an outer diameter D5;

the outer ring roller is designed to contact with the cam;

a clearance is formed between an inner circumference surface of the inner ring roller and the outer circumference surface of the roller shaft; and a clearance is formed between the outer circumference surface of the inner ring roller.

* * * * *